US008967031B2

(12) United States Patent
Mulcahey

(10) Patent No.: US 8,967,031 B2
(45) Date of Patent: Mar. 3, 2015

(54) WEAPON HAND SHIELD

(71) Applicant: Kevin Mulcahey, Fort Mill, SC (US)

(72) Inventor: Kevin Mulcahey, Fort Mill, SC (US)

( * ) Notice: Subject to any disclaimer, the term of this patent is extended or adjusted under 35 U.S.C. 154(b) by 0 days.

(21) Appl. No.: 13/749,061

(22) Filed: Jan. 24, 2013

(65) Prior Publication Data

US 2013/0213209 A1 Aug. 22, 2013

Related U.S. Application Data

(63) Continuation-in-part of application No. 29/413,510, filed on Feb. 16, 2012, now Pat. No. Des. 84,649.

(51) Int. Cl.

| | |
|---|---|
| ***F41H 5/12*** | (2006.01) |
| ***F41H 1/00*** | (2006.01) |
| ***F41C 27/04*** | (2006.01) |

(52) U.S. Cl.

CPC .. *F41H 1/00* (2013.01); *F41H 5/12* (2013.01); *F41C 27/04* (2013.01)

USPC ..... 89/36.07; 89/36.06; 89/928

(58) Field of Classification Search

CPC ..... F41H 5/08; F41H 5/12; F41H 5/013; F41C 27/04

USPC ..... 89/36.02, 36.06, 36.07, 928, 926, 1.42; 42/94, 85, 106

See application file for complete search history.

(56) References Cited

U.S. PATENT DOCUMENTS

| | | | | |
|---|---|---|---|---|
| 2,215,204 | A | 9/1940 | Young | |
| 6,408,733 | B1 * | 6/2002 | Perciballi | 89/36.02 |
| 6,559,079 | B1 * | 5/2003 | Bachner, Jr. | 442/246 |
| 6,595,101 | B2 | 7/2003 | Baker | |
| 6,886,446 | B1 | 5/2005 | Baker | |
| 7,111,424 | B1 * | 9/2006 | Moody et al. | 42/72 |
| 7,155,857 | B2 | 1/2007 | Elder | |
| 7,302,880 | B1 * | 12/2007 | Elasic | 89/36.07 |
| 7,520,206 | B2 | 4/2009 | Baker | |
| 7,685,756 | B2 * | 3/2010 | Moody et al. | 42/72 |
| 7,703,231 | B2 * | 4/2010 | Wei | 42/90 |
| 7,934,455 | B2 | 5/2011 | Winter | |
| 7,971,516 | B2 | 7/2011 | Hogan | |
| 8,511,215 | B1 * | 8/2013 | Tervola et al. | 89/36.06 |
| 2005/0217472 | A1 | 10/2005 | Baker | |
| 2009/0119968 | A1 * | 5/2009 | Lowell et al. | 42/106 |
| 2010/0132239 | A1 * | 6/2010 | Moody et al. | 42/72 |
| 2011/0056366 | A1 | 3/2011 | Ran | |

* cited by examiner

*Primary Examiner* — Bret Hayes
*Assistant Examiner* — Joshua Freeman
(74) *Attorney, Agent, or Firm* — Trego, Hines & Ladenheim, PLLC

(57) ABSTRACT

A hand shield assembly for a weapon includes: a flexible first hand shield made of penetration-resistant material, the first hand shield having opposed front and rear faces, and spaced-apart side edges connecting spaced-apart top and bottom edges, wherein a mounting point is defined near the top edge; and a mount attached to the mounting point and configured to attach the hand shield assembly to a weapon such that the first hand shield may hang vertically from the mount.

11 Claims, 21 Drawing Sheets

WEAPON HAND SHIELD

BACKGROUND OF THE INVENTION

This invention relates generally to firearms and other similar weapons, and more particularly to a defensive hand shield for a forward grip of a firearm.

Weapons such as firearms are frequently used in conditions which subject the weapon user to hazards such as return enemy fire and shrapnel. Various types of personal protective gear exist for weapon users, such as bullet-resistant vests, "flak jackets", "body armor", and the like.

While such conventional protective gear protects the user's torso and vital organs, his hands are still exposed to injury because of their position holding the weapon. The forward hand is particularly vulnerable.

Accordingly, there is a need for a shield providing protection for a weapon user's hands.

BRIEF SUMMARY OF THE INVENTION

This need is addressed by the present invention, which provides a modular hand shield that protects a user's hand and portions of the arm, while still permitting operation of a weapon.

According to one aspect of the invention, a hand shield assembly for a weapon includes: a flexible first hand shield made of penetration-resistant material, the first hand shield having opposed front and rear faces, and spaced-apart side edges connecting spaced-apart top and bottom edges, wherein a mounting point is defined near the top edge; and a mount attached to the mounting point and configured to attach the hand shield assembly to a weapon such that the first hand shield may hang vertically from the mount.

According to another aspect of the invention, a hand shield for a weapon includes: a rigid curved shell made of penetration-resistant material, the shell having opposed inner and outer surfaces; a mount disposed on the outer surface configured to attach the hand shield to a weapon; and a handle disposed inside the shell.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
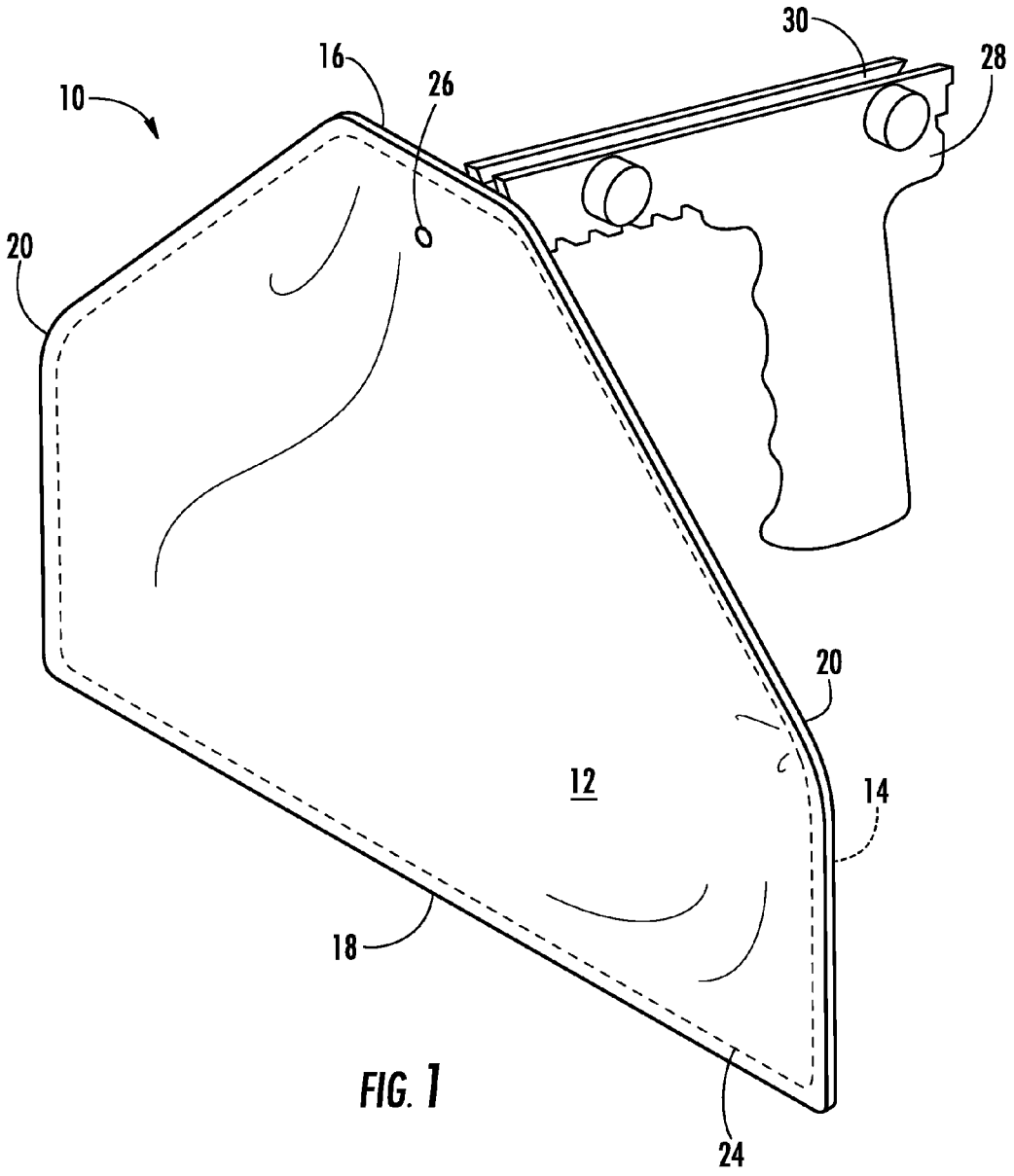
FIG. 1 is a perspective view of a hand shield constructed according to an aspect of the present invention, showing the hand shield attached to an accessory base.
Figure 2:
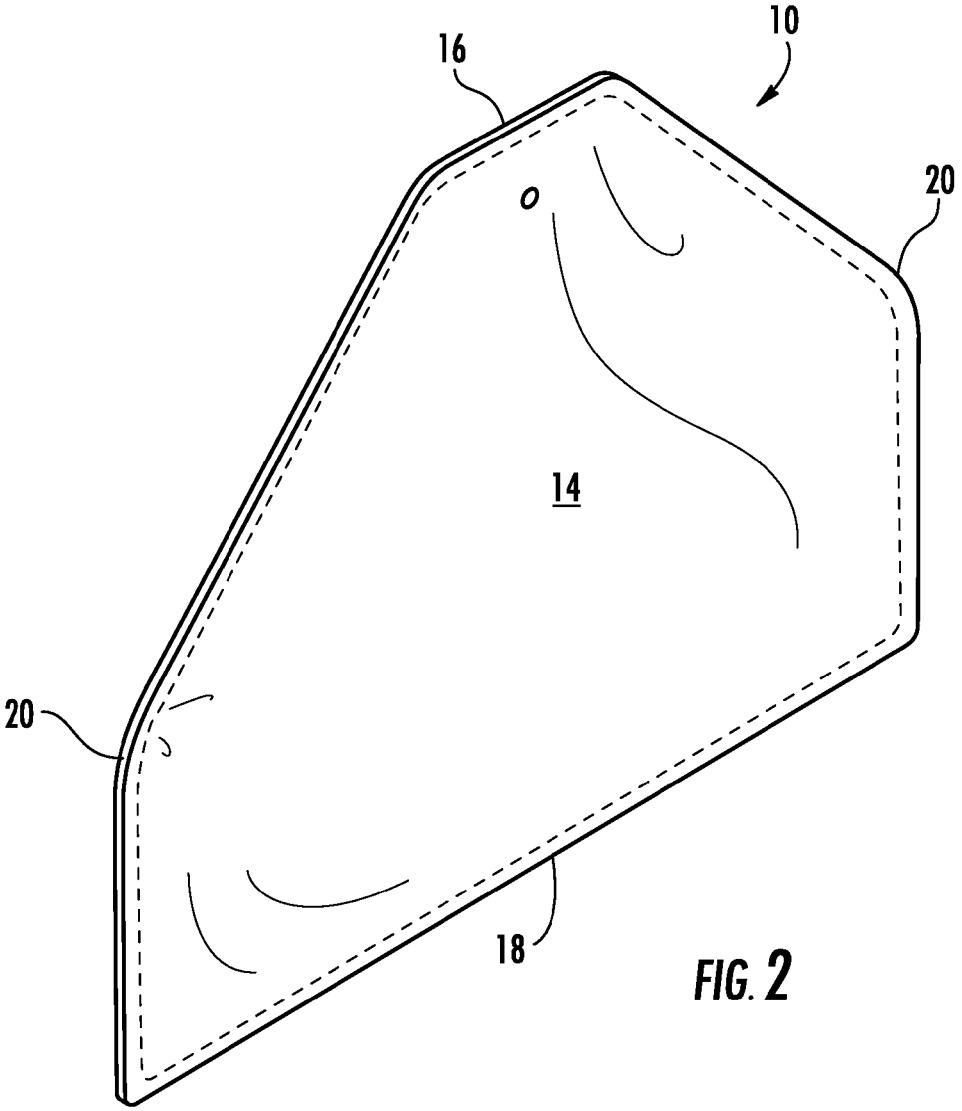
FIG. 2 is another perspective view of the hand shield of FIG. 1.
Figure 3:
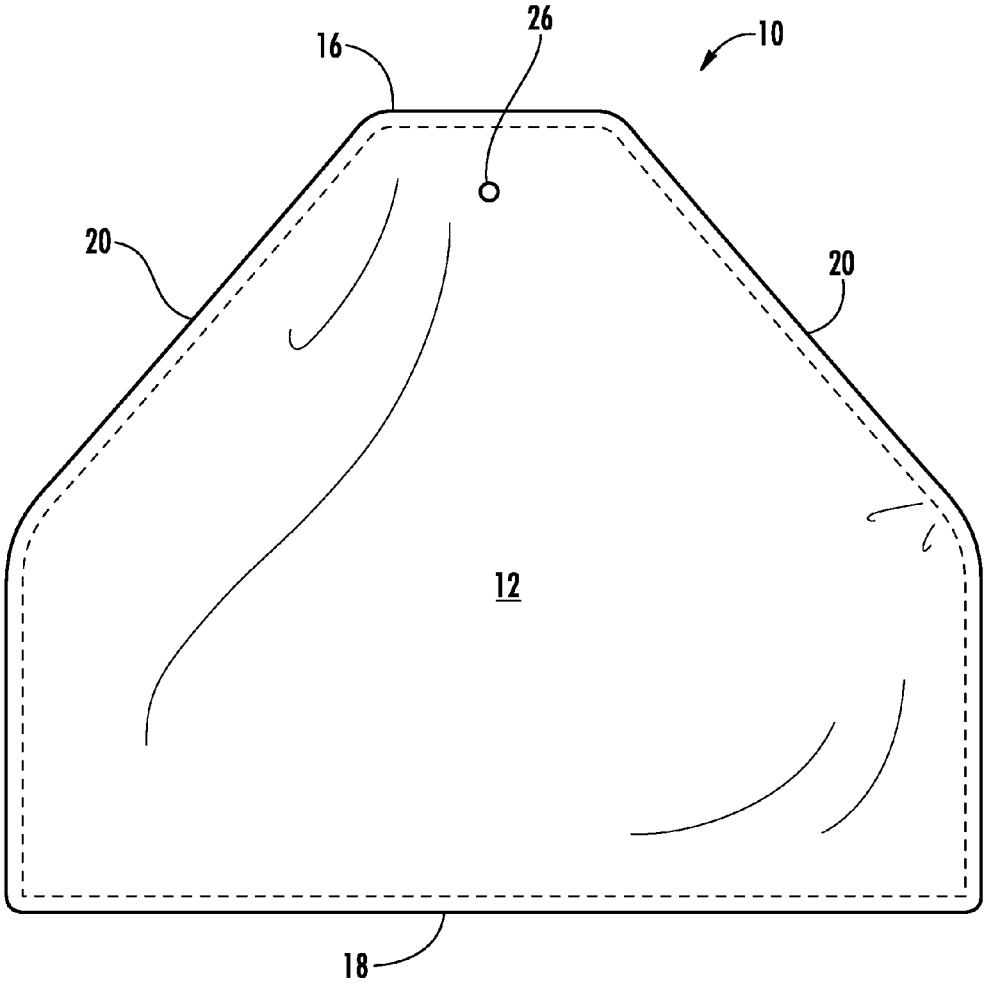
FIG. 3 is a front elevational view of the hand shield of FIG. 1.
Figure 4:
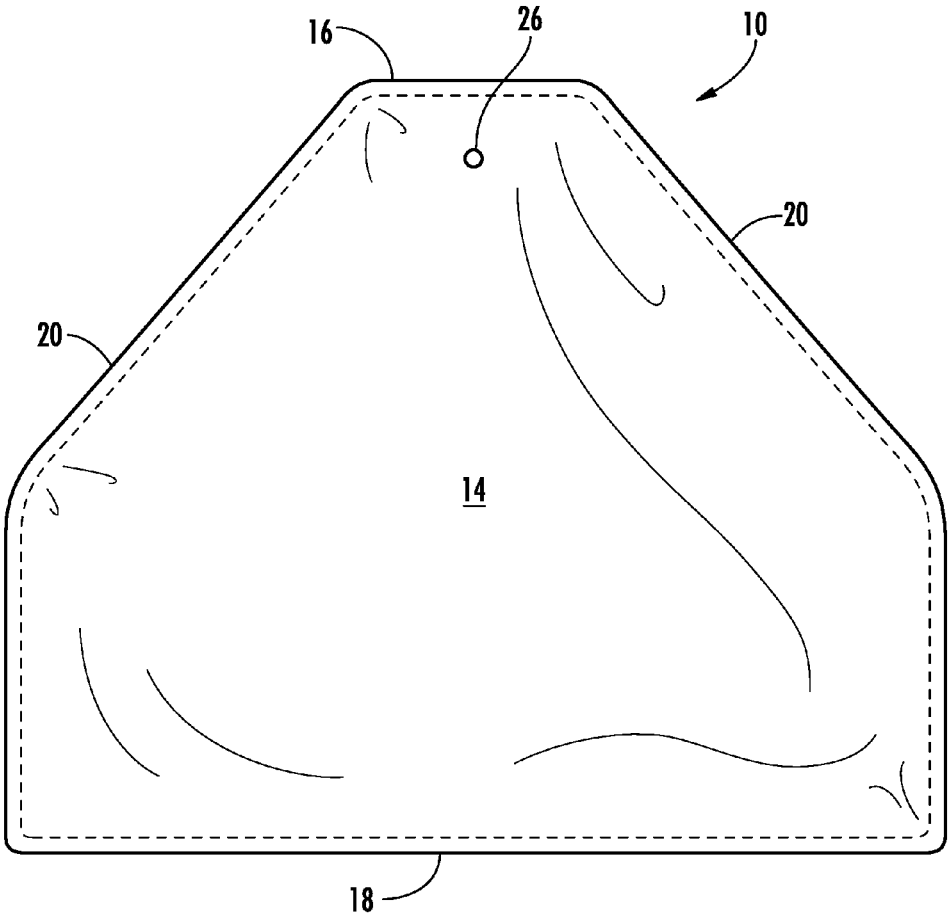
FIG. 4 is a rear elevational view of the hand shield of FIG. 1.
Figure 5:
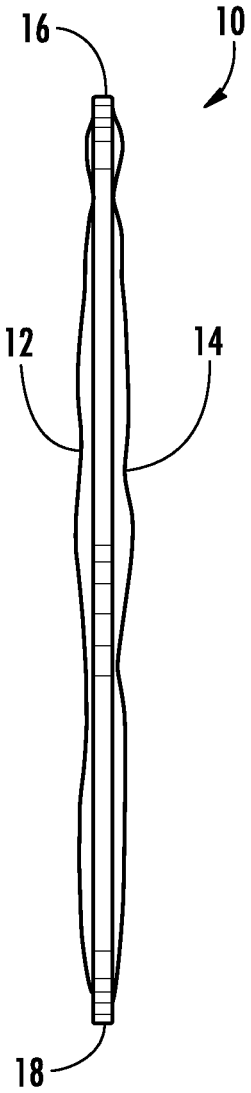
FIG. 5 is a right side elevational view of the hand shield of FIG. 1.
Figure 6:
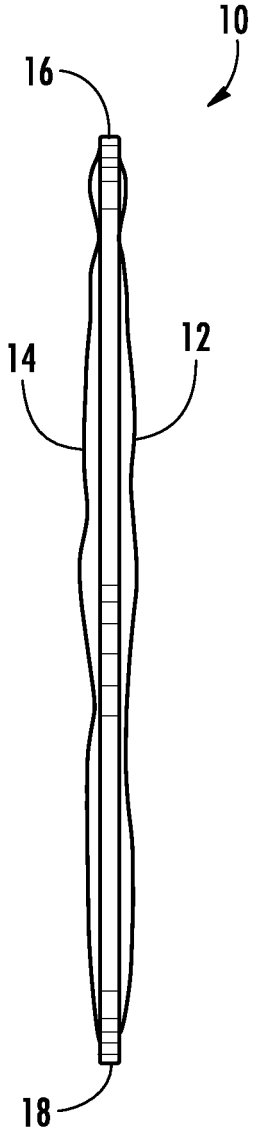
FIG. 6 is a left side elevational view of the hand shield of FIG. 1.
Figure 7:
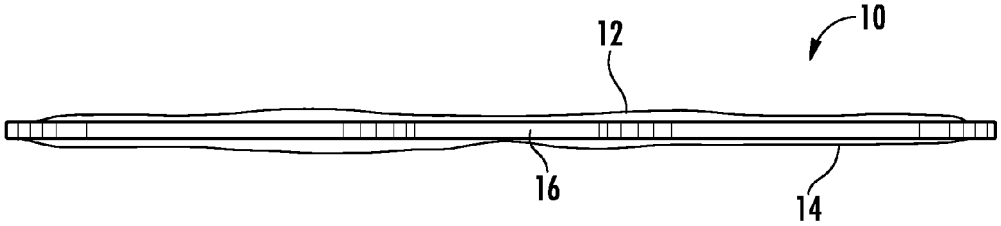
FIG. 7 is a top plan view of the hand shield of FIG. 1.
Figure 8:
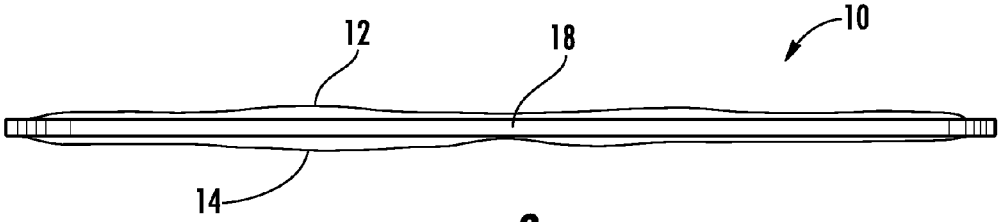
FIG. 8 is a bottom plan view of the hand shield of FIG. 1.

Referring to the drawings wherein identical reference numerals denote the same elements throughout the various views, FIGS. 1-8 illustrate an exemplary hand shield 10 constructed according to the present invention. The hand shield 10 has opposed front and rear faces 12 and 14, a top edge 16, and a bottom edge 18. Side edges 20 interconnect the top and bottom edges 16 and 18. In the illustrated example, each side edge includes a lower section that is perpendicular to the bottom edge 18, and an upper section that extends from the lower section to the top edge 16, making the upper portion of the hand shield 10 generally trapezoidal, and the lower portion generally rectangular.

The hand shield 10 is constructed so as to be penetration-resistant, or in other words resistant to penetration by moving projectiles, such as bullets and shrapnel. Non-limiting examples of suitable materials include metal alloys, ceramics, composite materials, and ballistic fabrics. In the illustrated example the hand shield 10 incorporates layers of fabric made from aramid fibers available under the trade name KEVLAR. The layers of fabric are sandwiched between front and rear cover layers of fabric that form the front and rear faces 12 and 14, respectively. The cover layers are secured together with stitching 24.

The construction of the hand shield 10 is flexible. As used herein, the term "flexible" refers to a structure configured such that it will flex or bend forwards and backwards under its own weight. Nonlimiting examples of flexible structures include structures made in whole or part from fabric.

The hand shield 10 includes an attachment point so that it can be mounted to a weapon. Most commonly it would be mounted to a firearm, particularly a rifle, but it will be understood that it may be mounted to any weapon where it is desired to protect the weapon user from projectiles, shrapnel, etc. In the illustrated example, a mounting hole 26 is formed near the top edge 16 to accept a screw or other fastener. In the illustrated example the hand shield 10 is attached to the forward end of an accessory base 28 that is configured to be attached to the forearm part of a rifle and which includes a "pistol grip" type handle extending downward therefrom. More particularly, in the illustrated example, the accessory base 28 has a dovetail groove 30 formed therein, and is configured to mate with a rail of a known type, for example a rail conforming to the U.S. Department of Defense document MIL-STD-1913, commonly referred to as a "Picatinny" rail (not shown in FIG. 1). Retention to the rail may be by one or more mechanical fasteners, or by a known type of releasable clamping mechanism. Together, the hand shield 10 and the accessory base 28 form a hand shield assembly.

Figure 9:
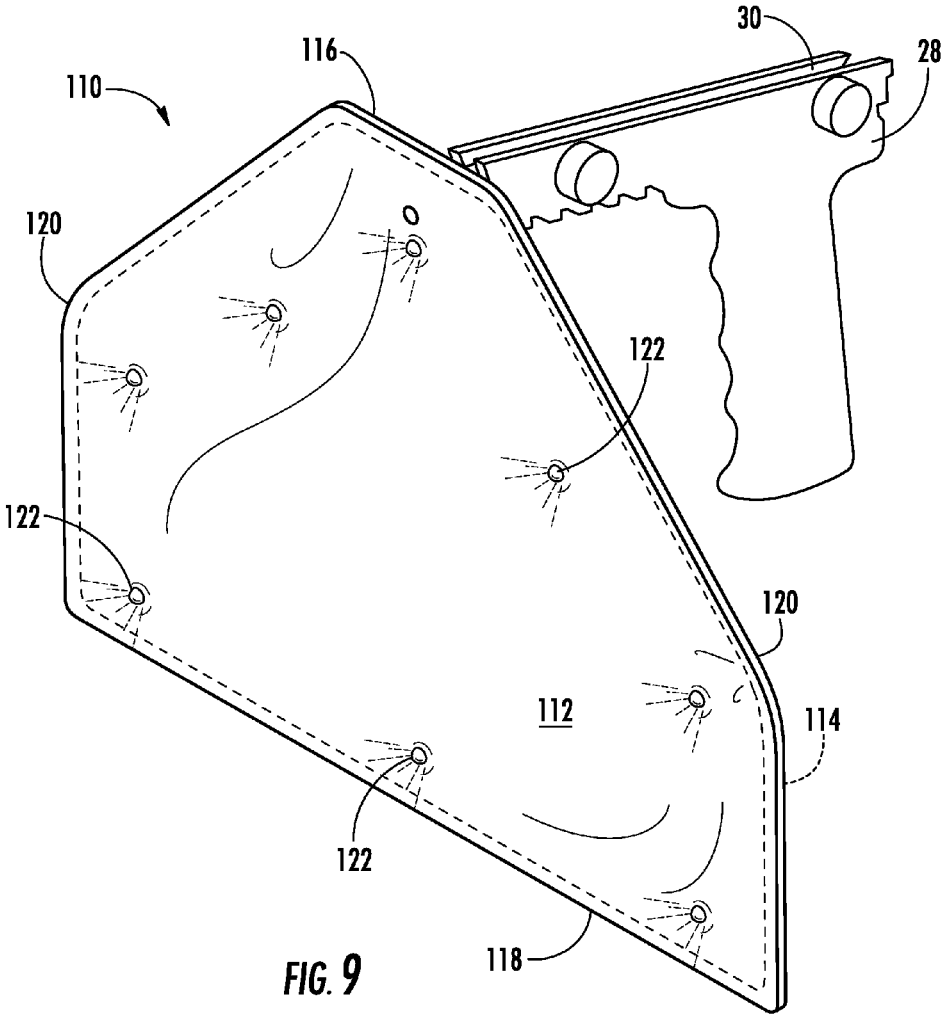
FIG. 9 is a perspective view of an alternative hand shield incorporating a plurality of lights, attached to an accessory base.
Figure 10:
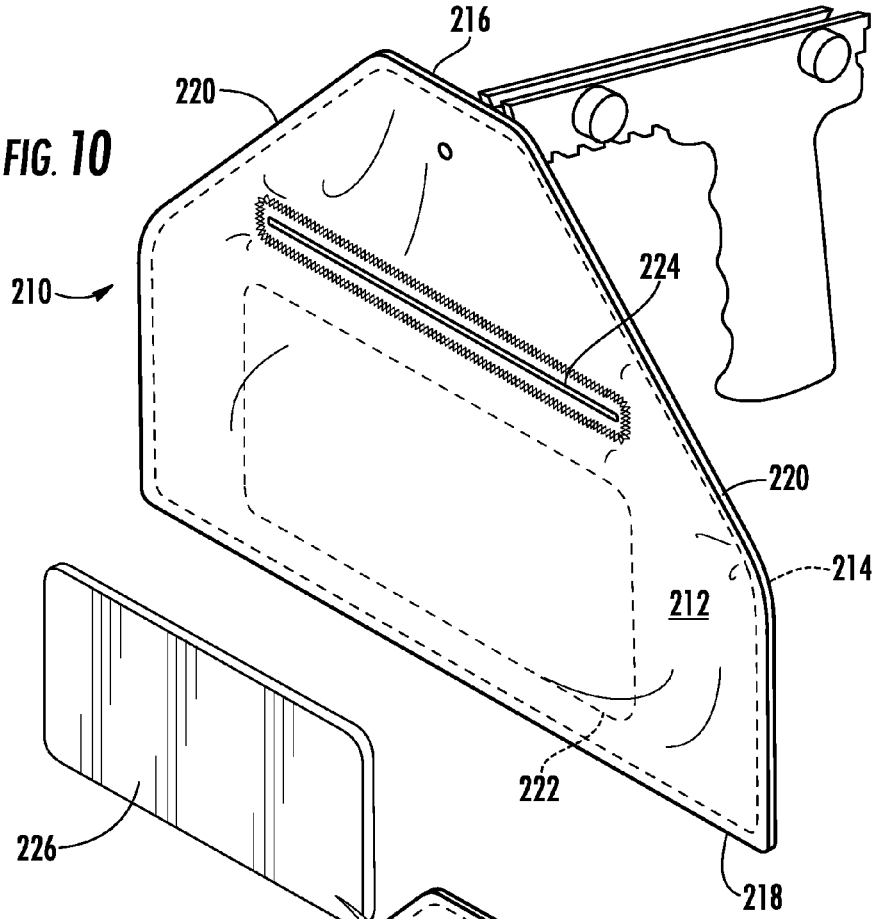
FIG. 10 is a perspective view of another hand shield for a gun with a pocket for receiving a reinforcing plate, attached to an accessory base.
Figure 11:
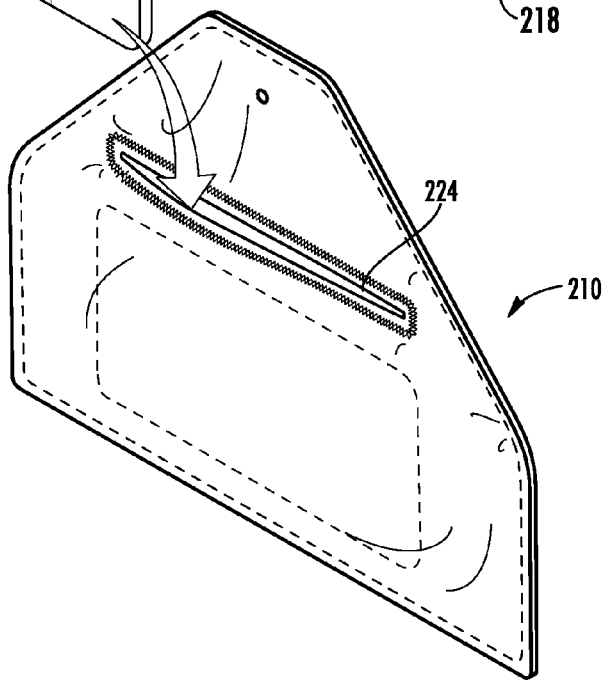
FIG. 11 is another perspective view of the hand shield of FIG. 10.
Figure 12:
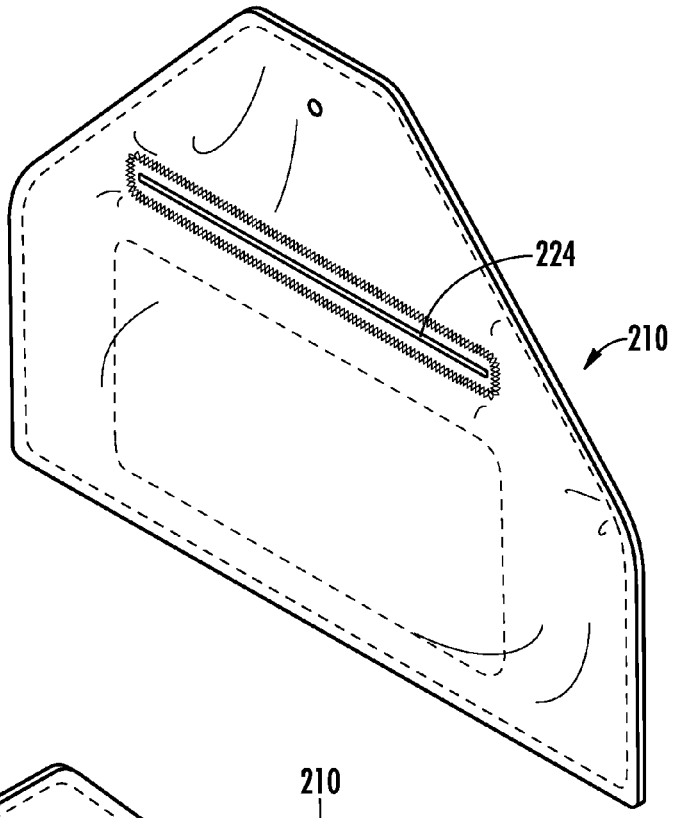
FIG. 12 is a perspective front view of the hand shield of FIG. 10.
Figure 13:
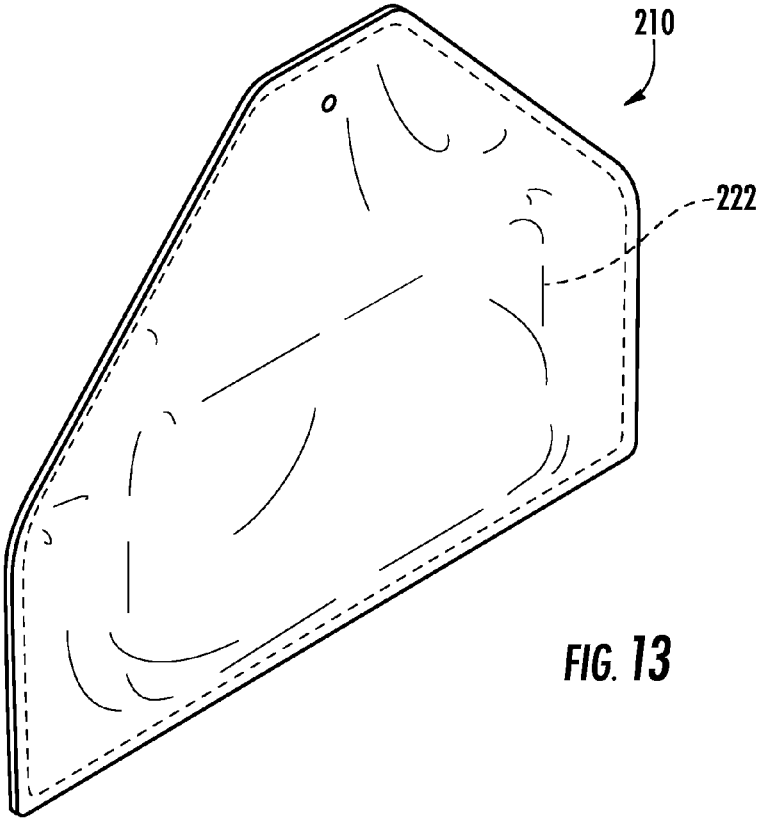
FIG. 13 is a perspective rear view of the hand shield of FIG. 10.

FIG. 9 illustrates a hand shield 110 similar in construction to the hand shield 10 described above. The hand shield 110 has opposed front and rear faces 112 and 114, top and bottom edges 116 and 118, and side edges 120. A plurality of lights 122 are disposed on the front face 112. Any type of light-emitting device may be used for this purpose, and the wavelength of the light may be varied to suit the end use. For example, visible light may be used for general illumination, while infrared light (IR) may be used to supplement active or passive night-vision devices. In the illustrated example, the lights 122 comprising light-emitting diodes (LEDs) of a known type, emitting in the visible light spectrum. The lights 122 may be supplied with electrical power by appropriate wiring incorporated into the hand shield 110 (not shown) and may be connected to an electrical power source like a battery (not shown) through a switch for selective activation.

FIGS. 10-13 illustrate another flexible hand shield 210 similar in construction to the hand shield 110 described above. The hand shield 210 has opposed front and rear faces 212 and 214, top and bottom edges 216 and 218, and side edges 220. The hand shield 210 incorporates an internal pocket 222 that communicates with an opening 224 formed in the front face 212. The opening 224 could also be formed in the rear face 214. The pocket 222 is sized and shaped to hold a reinforcing plate 226. The reinforcing plate is configured to increase the resistance of the hand shield 210 to penetration, and may be made from a material such as steel, ceramic, or other material. As shown, the opening 224 may be placed at the upper end of the pocket 222 so that the reinforcing plate 226 is naturally held in position by gravity during use.

Figure 14:
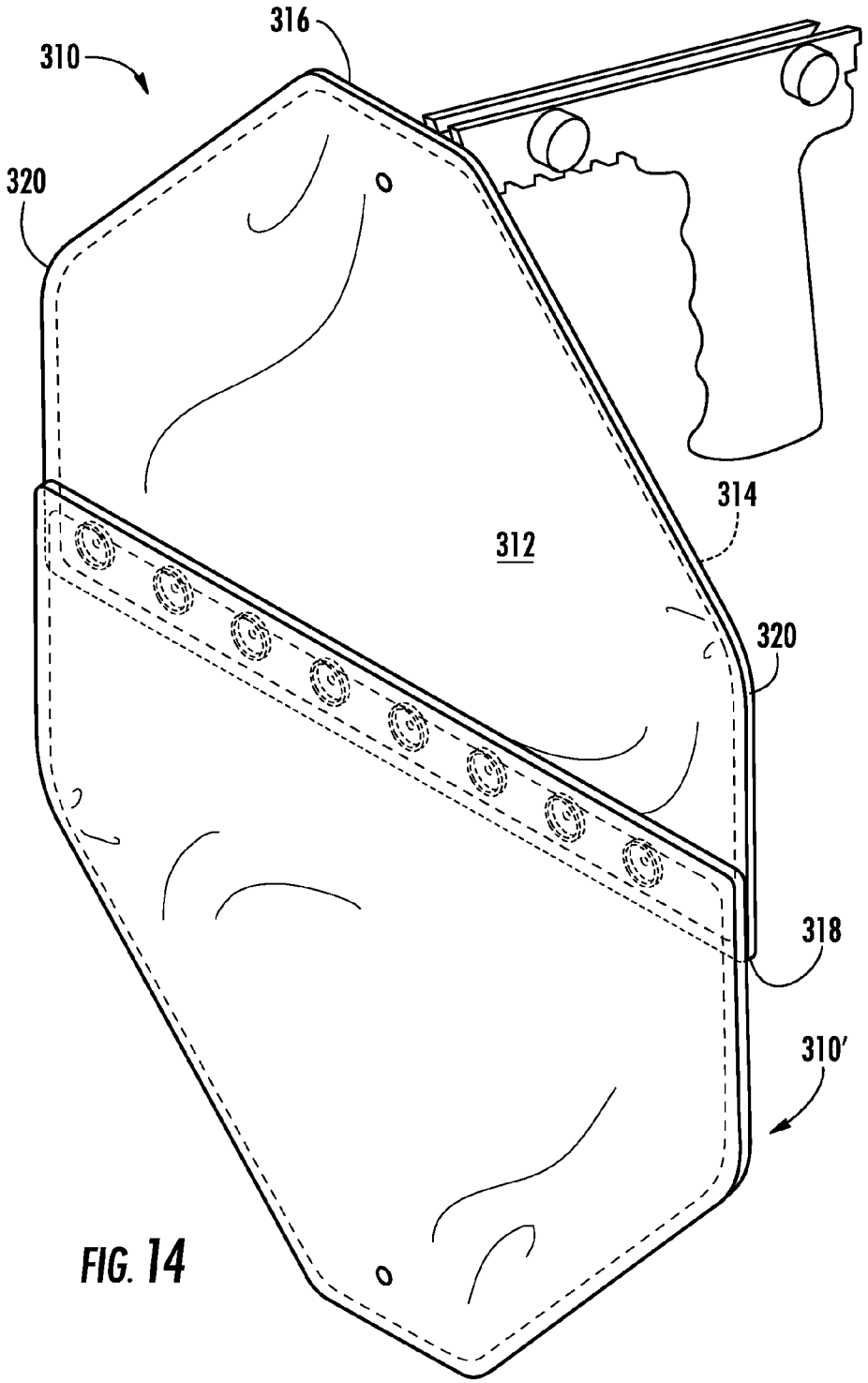
FIG. 14 is a perspective view of another hand shield including two hand shield portions attached to each other with a plurality of snaps, attached to an accessory base.
Figures 15, 16:
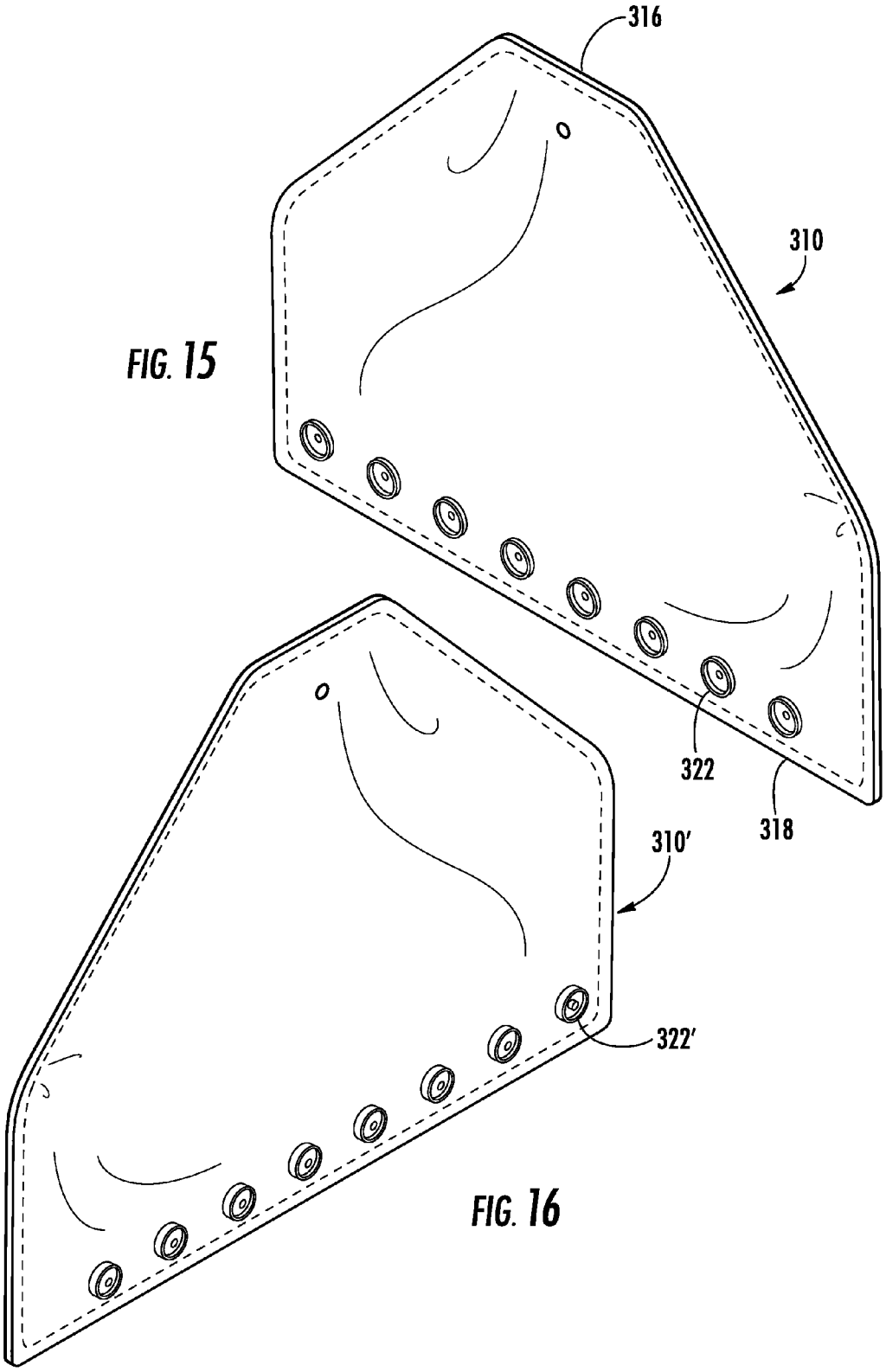
FIG. 15 is a front perspective view of the hand shield of FIG. 14.
FIG. 16 is a rear perspective view of a second hand shield for use with the hand shield of FIG. 14.

FIGS. 14-16 illustrate another flexible hand shield 310 similar in construction to the hand shield 110 described above. The hand shield 310 opposed front and rear faces 312 and 314, top and bottom edges 316 and 318, and side edges 320. The hand shield 310 is configured with a coupling device at or near its bottom edge 318 so that a second, similar hand shield can be attached thereto For example, FIG. 15 illustrates that the hand shield 310 includes a row of snaps 322 disposed along the bottom edge 318, with their working faces exposed along the front face 312. A second hand shield 310' is provided which is identical in shape and size to the first hand shield 310. It includes another row of snaps 322' that are complementary to the other snaps 322. When the pairs of snaps 322 and 322' are engaged the second hand shield 310' hangs below the first hand shield 310, doubling the size of the area protected.

Figure 17:
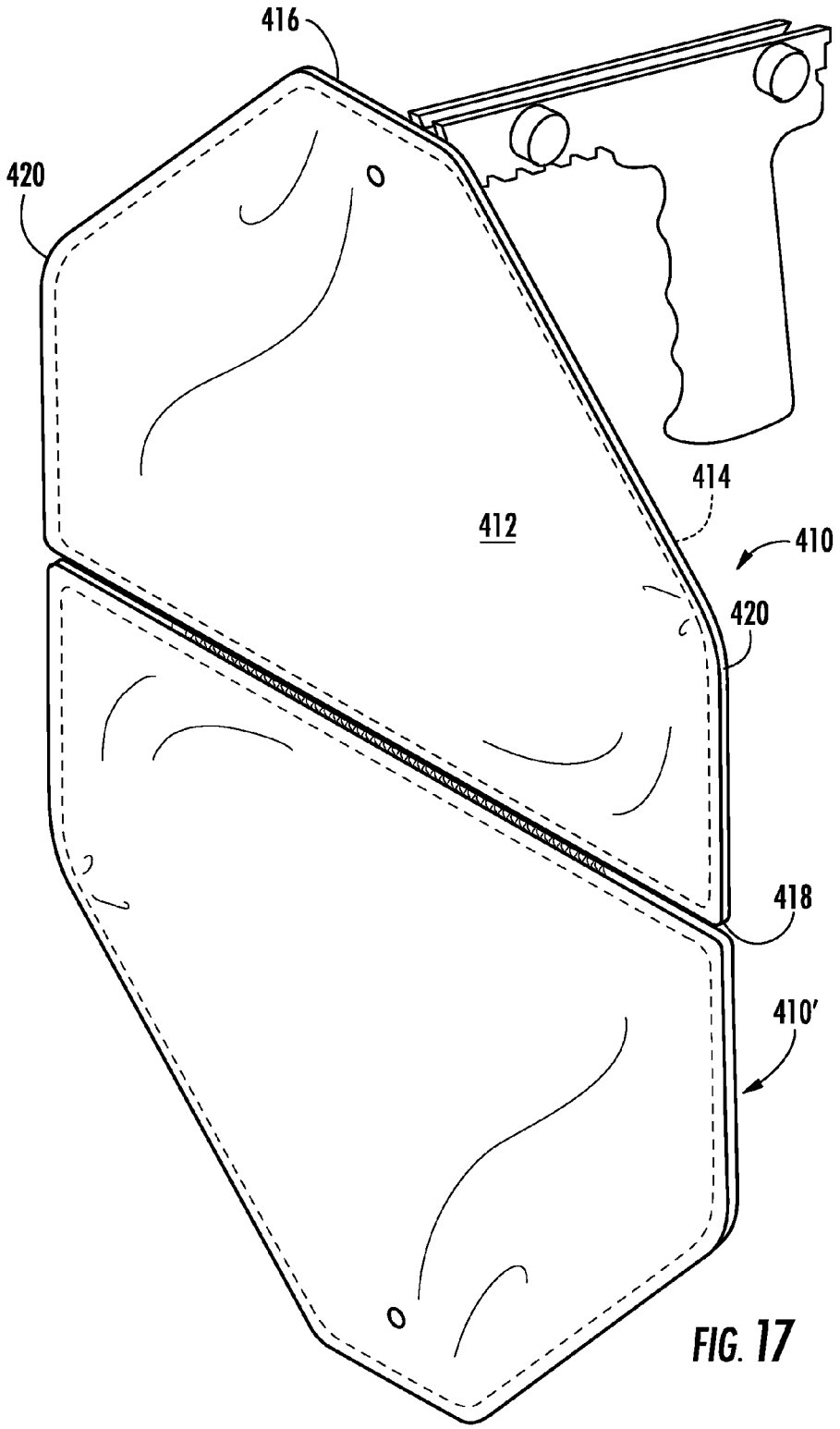
FIG. 17 is a perspective view of another hand shield having two hand shield portions connected together with a zipper, attached to an accessory base.
Figure 18:
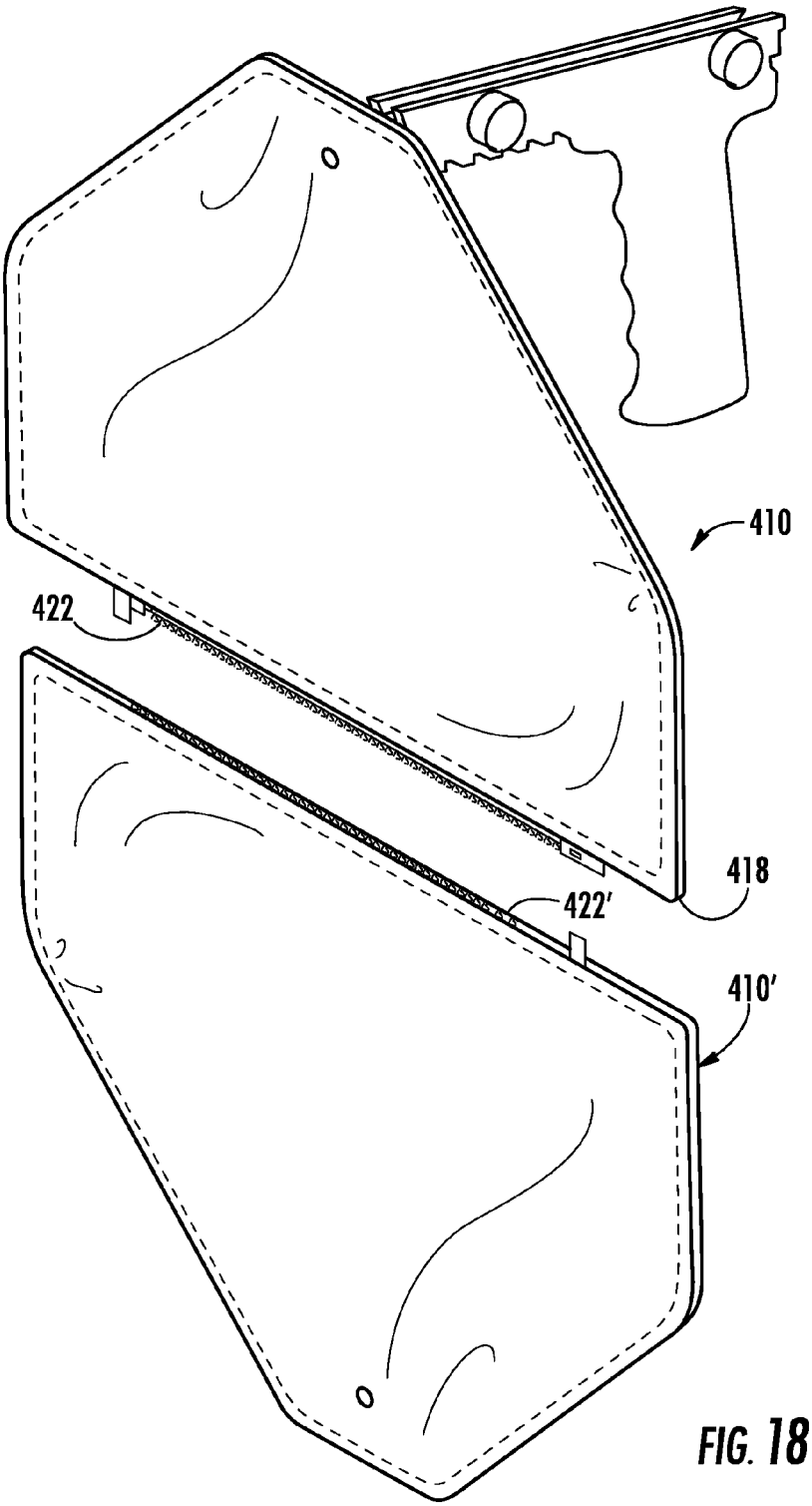
FIG. 18 is an exploded perspective view of the hand shield of FIG. 17.
Figure 19:
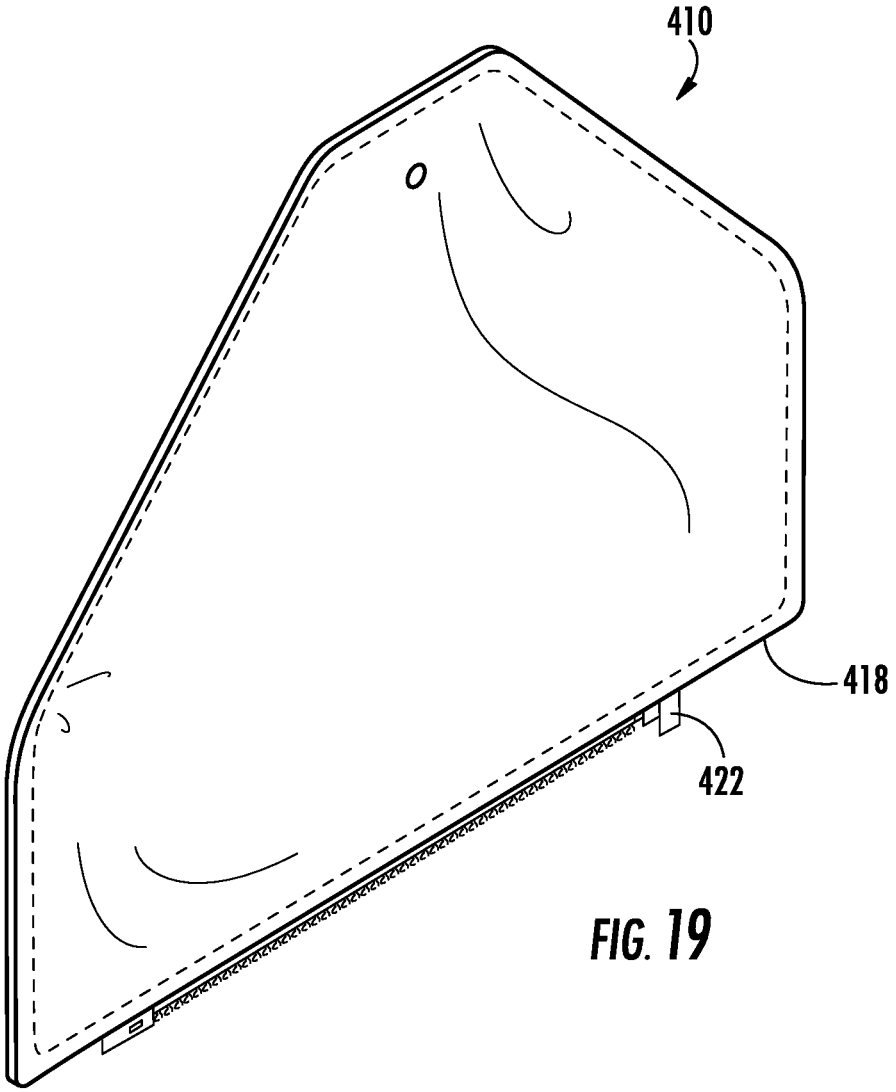
FIG. 19 is a rear perspective view of a portion of the hand shield of FIG. 17.

Various means may be used to couple two hand shields together. For example, FIGS. 17-19 illustrate another flexible hand shield 410 similar in construction to the hand shield 310 described above. The hand shield 410 has opposed front and rear faces 412 and 414, top and bottom edges 416 and 418, and side edges 420. FIG. 19 illustrates that the hand shield 410 includes a zipper portion 422 disposed along the bottom edge 418. A second hand shield 410' is provided which is identical in shape and size to the first hand shield 410. It includes another zipper portion 422' that is complementary to the first zipper 422. When the zipper portions 422 and 422' are engaged the second hand shield 410' hangs below the first hand shield 410, doubling the size of the area protected.

Figure 20:
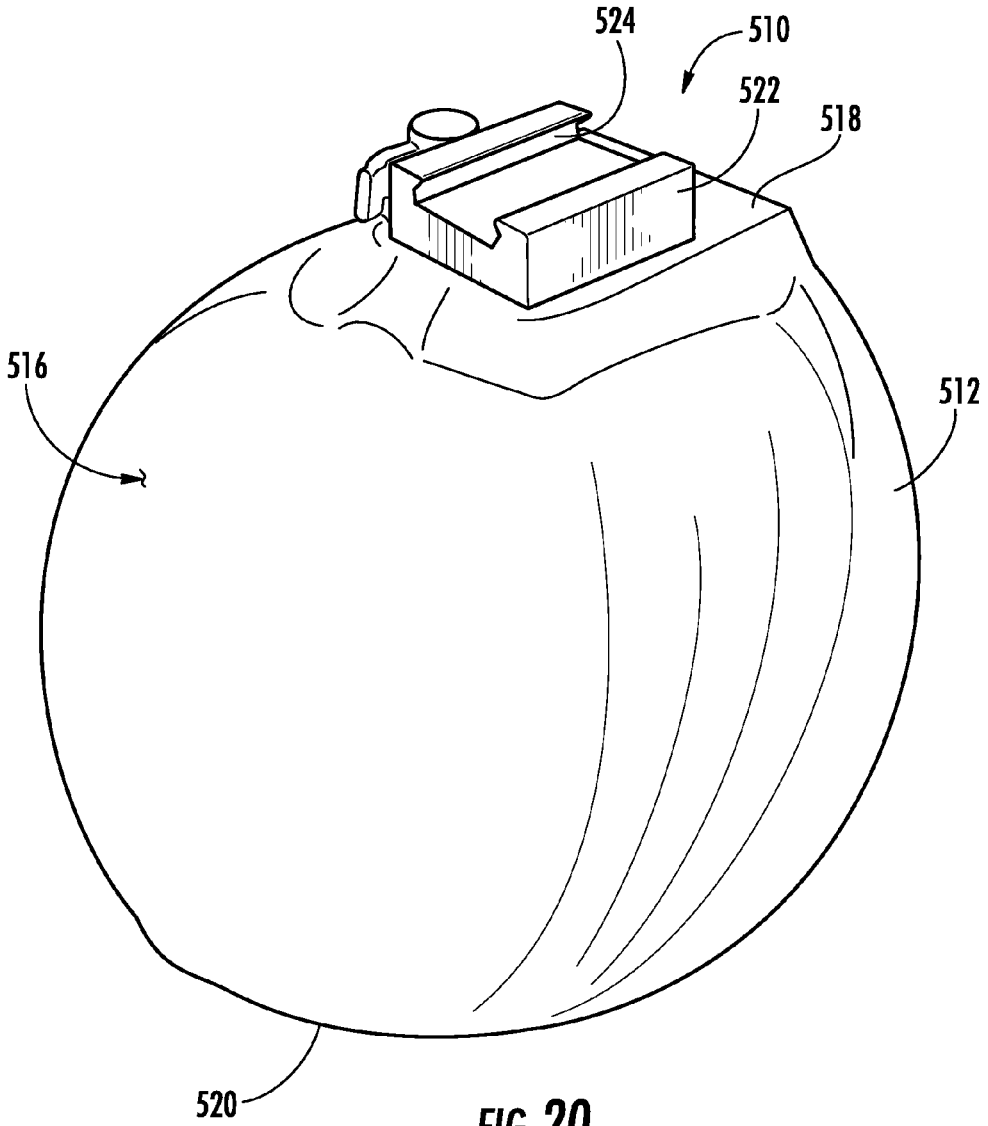
FIG. 20 is a perspective view of a rigid hand shield.
Figure 21:
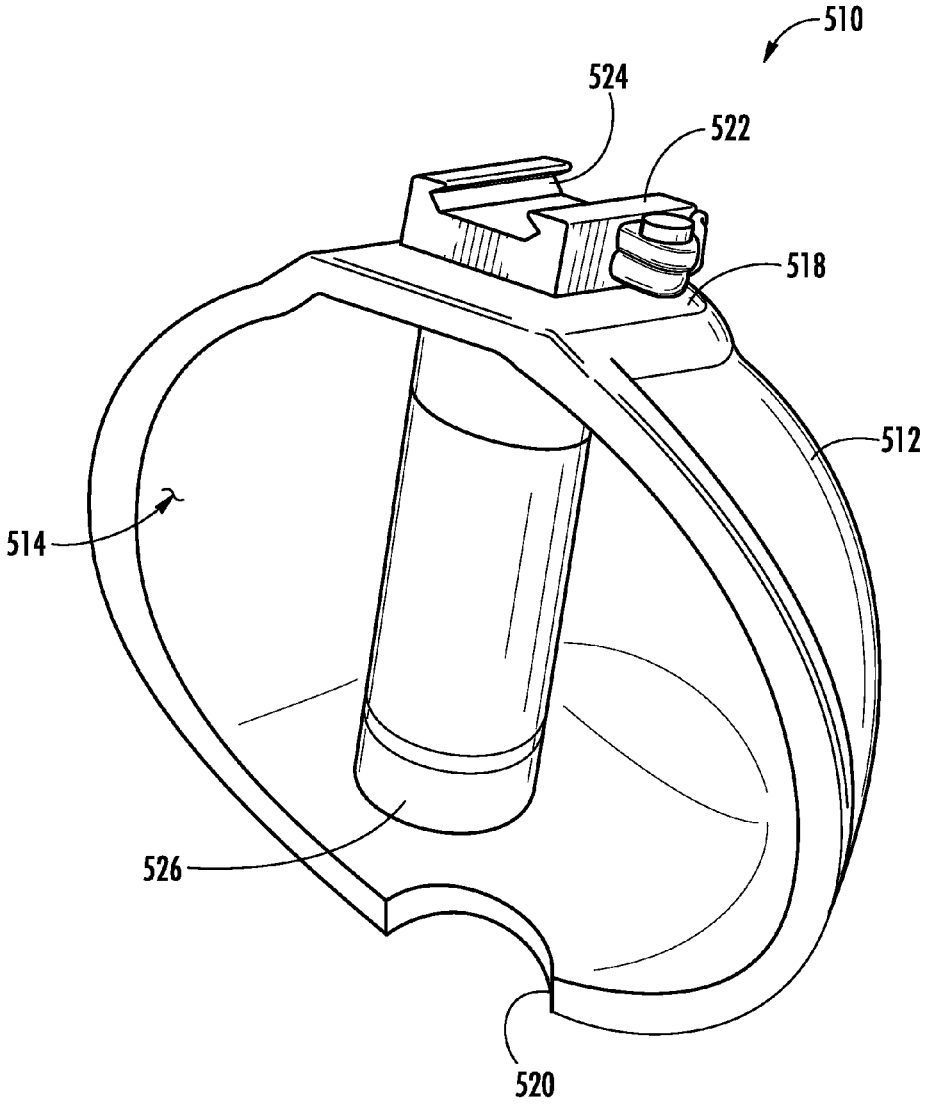
FIG. 21 is a rear perspective view of the hand shield of FIG. 20.

FIGS. 20 and 21 illustrate an alternative hand shield 510. As explained in more detail below it may be used alone or in combination with any of the flexible hand shields described above. It includes a shell 512 which is roughly hemispherical with inner and outer surfaces 514 and 516, respectively, an upper end 518, and a lower end 520. The hand shield 512 is rigid. As used herein the term "rigid" refers to a structure that generally maintains its shape and does not flex or bend under its own weight, and the term "rigid" has a meaning opposite to the term "flexible".

The shell 512 is constructed from a material that is resistant to penetration by moving projectiles, such as bullets and shrapnel. Non-limiting examples of suitable materials include metal alloys, ceramics, composite materials, and ballistic fabrics. In the illustrated example the shell 512 is constructed from a composite comprising a cured polymer resin matrix incorporating layers of aramid fibers available under the trade name KEVLAR.

A mount 522 is disposed on the outer surface 516 at the upper end 518 of the shell 512. The mount 522 may include any structure suitable to attach the hand shield 510 to a firearm or similar weapon. In the illustrated example, the mount 522 is a clamp having a dovetail groove 524 formed therein, configured to mate with a Picatinny rail as described above. The mount 522 itself may be attached to the shell 512 by mechanical fasteners, by adhesives, or by co-molding with the shell 512.

A handle 526 is disposed inside the shell 512 and is oriented generally vertically to provide a secure grip. In the illustrated example the handle 526 has a generally circular cross-sectional shape, and is integrally formed with the mount 522.

Figure 22:
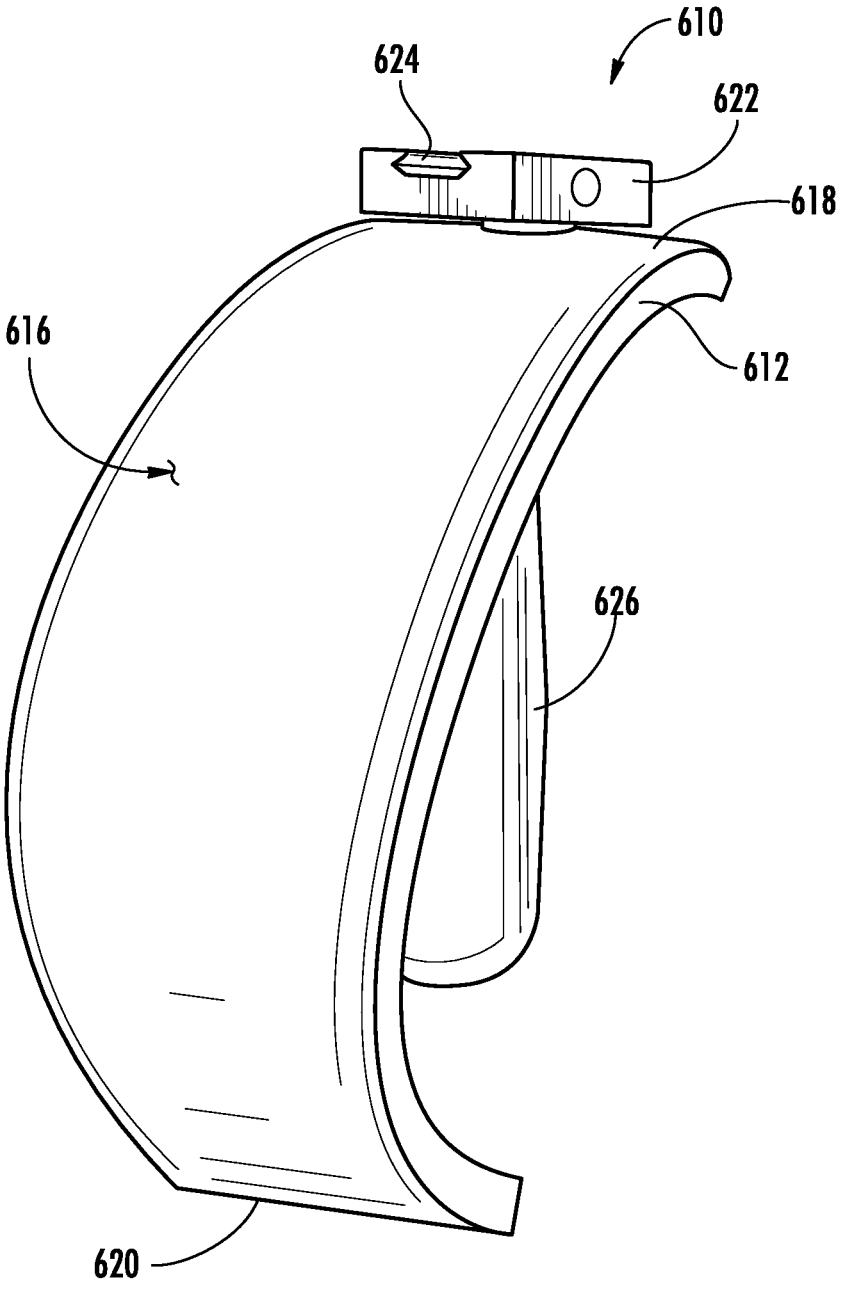
FIG. 22 is a perspective view of another rigid hand shield.
Figure 23:
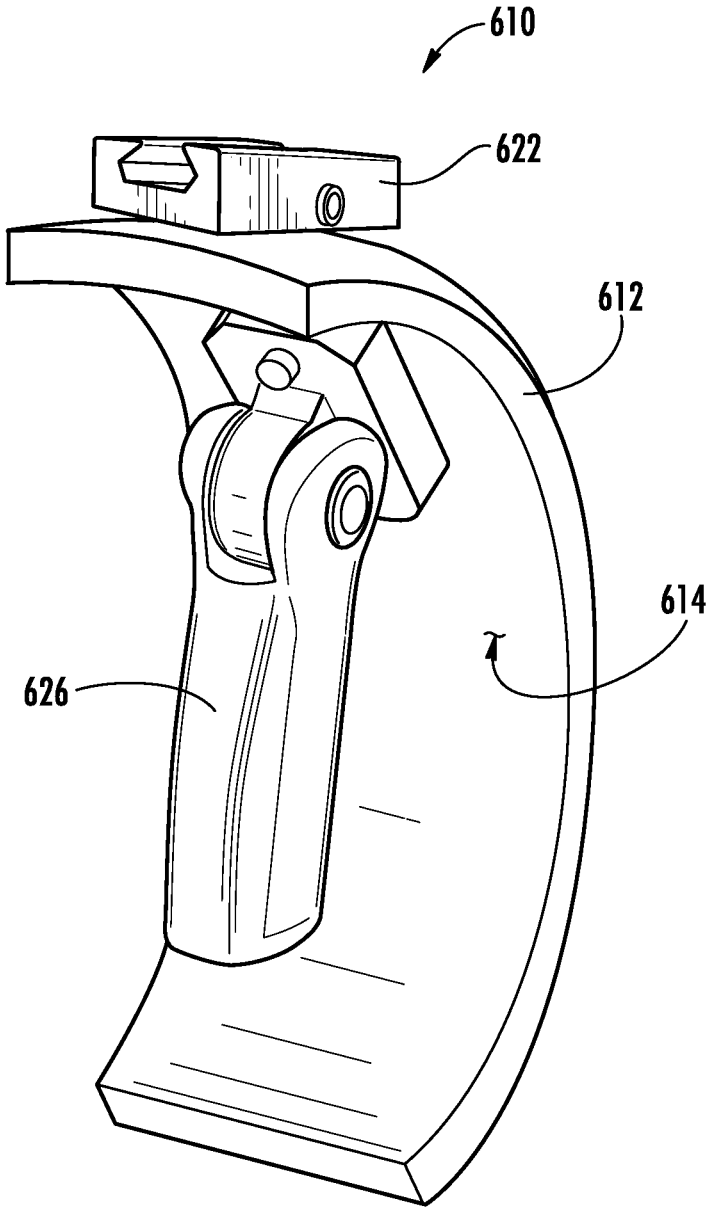
FIG. 23 is a rear perspective view of the hand shield of FIG. 22.

FIGS. 22 and 23 illustrate an alternative hand shield 610. It includes a shell 612 which is roughly C-shaped with inner and outer surfaces 614 and 616, respectively, an upper end 618, and a lower end 620. Like the hand shield 510 described above, the hand shield 610 is rigid rather than flexible.

The shell 612 is constructed from a material that is resistant to penetration by moving projectiles, such as bullets and shrapnel. Non-limiting examples of suitable materials include metal alloys, ceramics, composite materials, and ballistic fabrics. In the illustrated example the shell 612 is constructed from a composite comprising a polymer matrix with layers of aramid fibers available under the trade name KEVLAR.

A mount 622 is disposed on the outer surface 616 at the upper end 618 of the shell 612. The mount 622 may include any structure suitable to attach the hand shield 610 to a firearm or similar weapon. In the illustrated example, the mount 622 is a clamp having a dovetail groove 624 formed therein, configured to mate with a Picatinny rail as described above. The mount 622 may be attached to the shell 612 by mechanical fasteners, by adhesives, or by co-molding with the shell 612.

A handle 626 is mounted inside the shell 612 and is oriented generally vertically to provide a secure grip.

Figure 24:
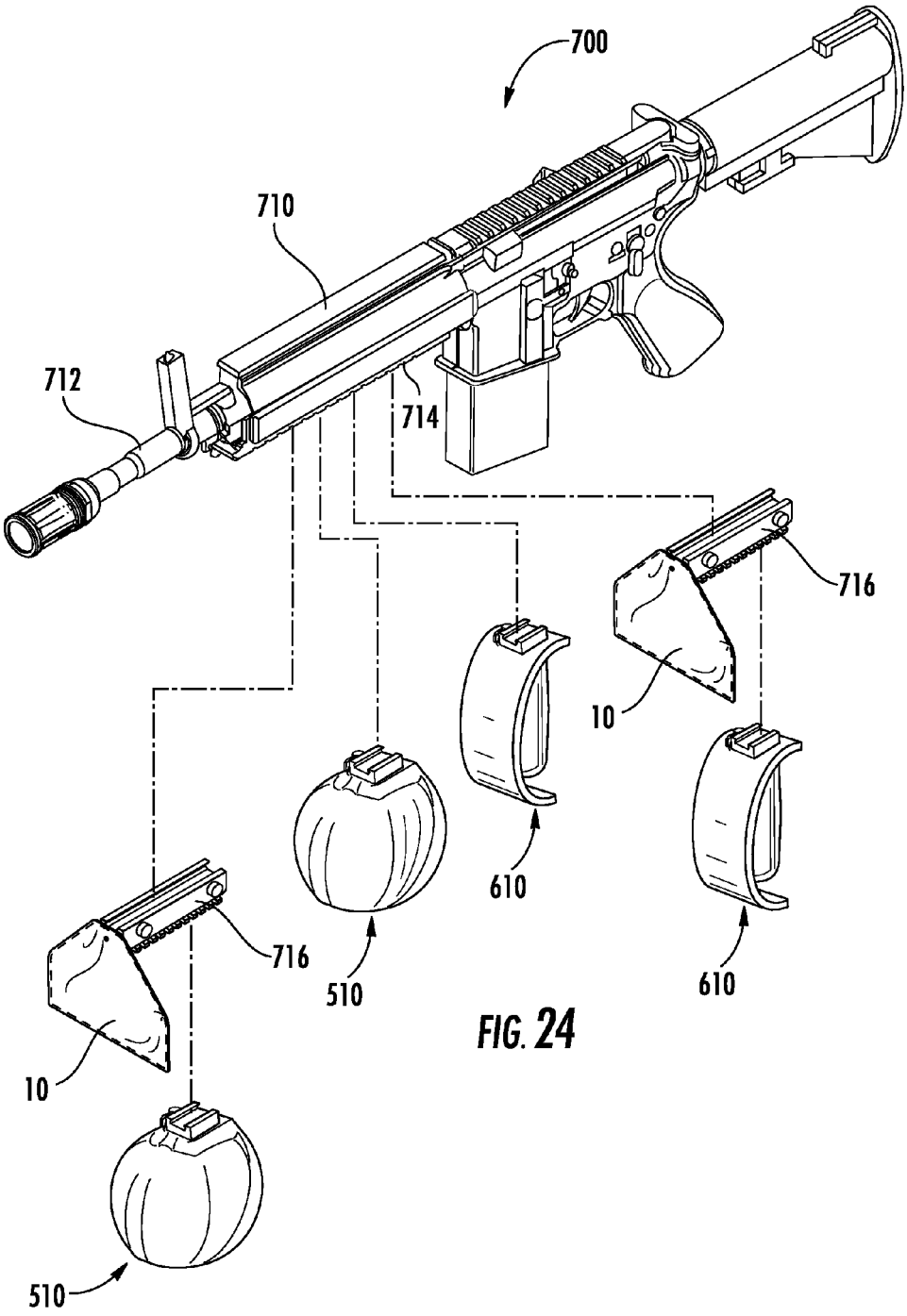
FIG. 24 is an exploded perspective view of a rifle along with a flexible hand shield and two optional hand shields.
Figure 25:
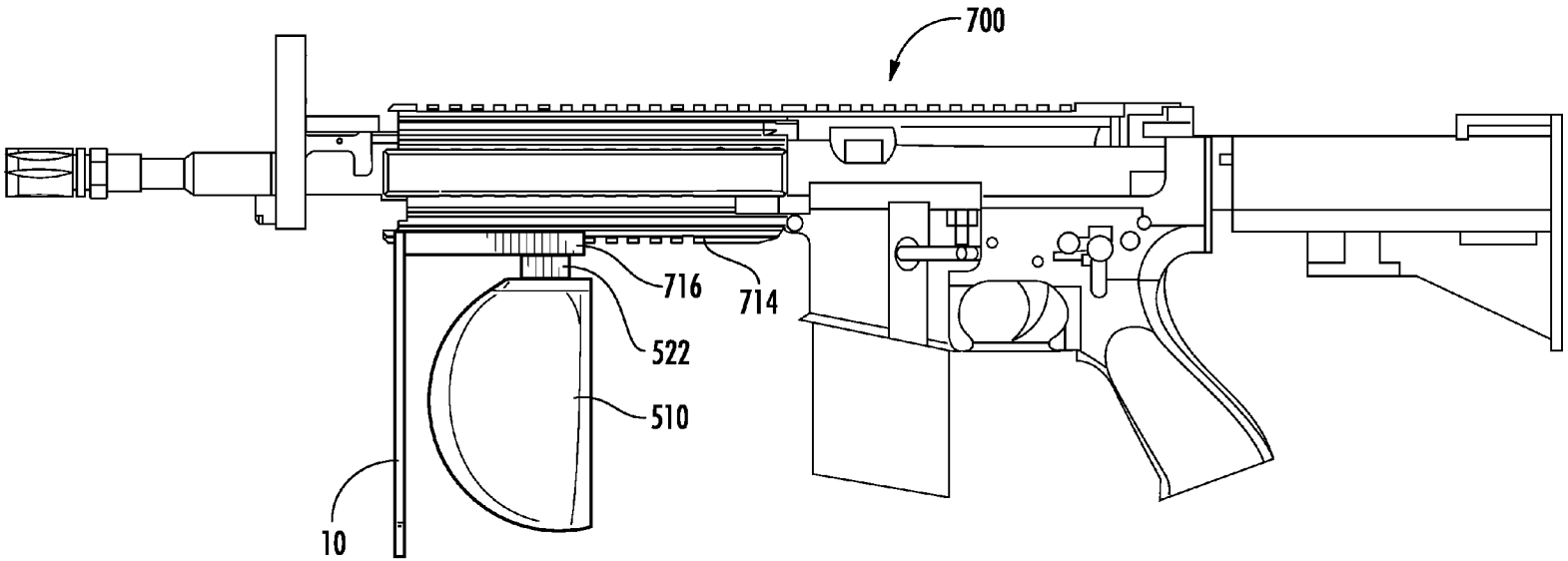
FIG. 25 is a side view of the hand shield of FIG. 20 attached to a rifle, along with the hand shield of FIG. 1.
Figure 26:
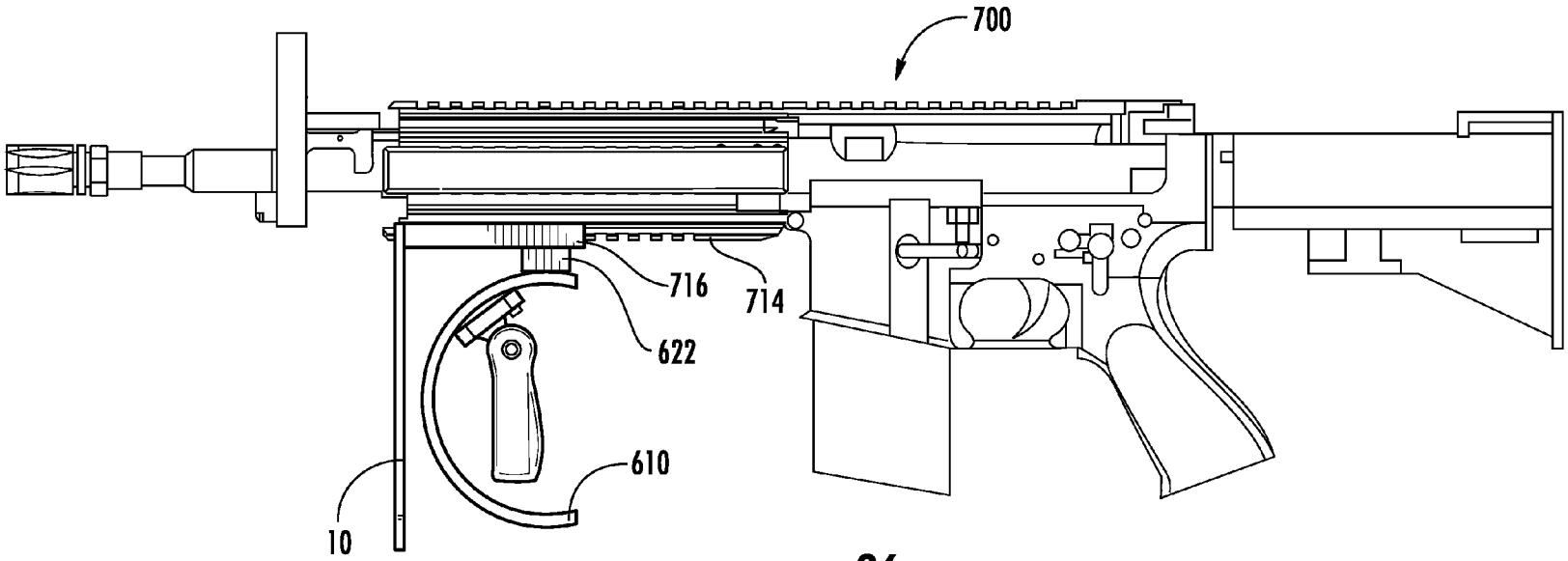
FIG. 26 is a side view of the hand shield of FIG. 22 attached to a rifle, along with the hand shield of FIG. 1

FIGS. 24-26 show how the hand shields described above may be mounted to a firearm. A rifle 700 of a known type includes a forearm 710 surrounding a barrel 712. The forearm

710 is a of a known type including at least one accessory rail 714, for example a Picatinny rail as described above. FIG. 24 is an exploded view showing how either of the rigid hand shields 510 or 610 shown above may be mounted to the rifle 700 in combination with any of the flexible hand shields 10, 110, 210, 310, or 410 described above. In FIG. 24, the hand shield 10 is shown as an example, and is mounted to the accessory rail 714 by an accessory base 716 that includes a dovetail groove on its upper surface and a Picatinny rail on its lower surface. Optionally, either of the rigid hand shields 510 or 610 may be mounted directly to the forearm 710 of the rifle 700 and used without any flexible hand shields.

In FIG. 25, a flexible shield 10 is mounted to the accessory rail 714 by an accessory base 716 that includes a dovetail groove on its upper surface and a Picatinny rail on its lower surface. A generally hemispherical rigid shield 510 is mounted to the base accessory base 716 with its mount 522 engaging the Picatinny rail. This configuration provides the rifle's user with a forward handle as well as two separate layers of protection from injury from projectiles, shrapnel, etc.

In FIG. 26, a flexible shield 10 is mounted to the accessory rail 714 by an accessory base 716 that includes a dovetail groove on its upper surface and a Picatinny rail on its lower surface. A generally C-shaped rigid shield 610 is mounted to the base accessory base 716 with its mount 622 engaging the Picatinny rail. This configuration provides the rifle's user with a forward handle as well as two separate layers of protection from injury from projectiles, shrapnel, etc.

The foregoing has described a hand shield for a weapon. While specific embodiments of the present invention have been described, it will be apparent to those skilled in the art that various modifications thereto can be made without departing from the spirit and scope of the invention.

What is claimed is:

1. A hand shield assembly for a weapon, comprising:

a first hand shield comprising:

a rigid curved C-shaped shell made of penetration-resistant material, the shell having opposed inner and outer surfaces;

a mount disposed on the outer surface configured to attach the hand shield to a weapon, the mount including a dovetail groove configured to accept a Picatinny rail; and a handle disposed inside the shell;

an accessory base including a dovetail groove configured to accept a Picatinny rail formed on an upper surface thereof, and a Picatinny rail formed on a lower surface thereof, wherein the dovetail groove of the mount is attached to the Picatinny rail of the accessory base; and a flexible second hand shield made of penetration-resistant material, the second hand shield having opposed front and rear faces, and spaced-apart side edges connecting spaced-apart top and bottom edges, wherein a mounting point is defined near the top edge, the mounting point being attached to the accessory rail such that the second hand shield may hang vertically from the accessory base.

2. The hand shield assembly of claim 1 wherein the second hand shield has:

an upper portion which is trapezoidal in shape, the upper portion incorporating the top edge; and a lower portion which is rectangular in shape, the lower portion incorporating the bottom edge.

3. The hand shield assembly of claim 1 wherein the second hand shield is made from fabric comprising aramid fibers.

4. The hand shield assembly of claim 1 wherein the front face has at least one light disposed thereon.

5. The hand shield assembly of claim 1 wherein the second hand shield includes:

a pocket communicating with an opening formed in one of the front and rear faces; and a reinforcing plate disposed in the pocket.

6. The hand shield assembly of claim 1 wherein the second hand shield includes a first coupling device disposed at or near its lower edge.

7. The hand shield assembly of claim 6 wherein a flexible third hand shield made of penetration-resistant material and including a second coupling device is attached to the second hand shield, with the first and second coupling devices mutually engaged.

8. The hand shield assembly of claim 7 wherein the first and second coupling devices are complementary snaps.

9. The hand shield assembly of claim 7 wherein the first and second coupling devices are complementary zipper portions.

10. The hand shield assembly of claim 1 wherein the shell has a hemispherical shape.

11. The hand shield assembly of claim 1 wherein the shell comprises a polymer matrix incorporating layers of aramid fibers.

* * * * *